US012502570B2

(12) United States Patent
Kopf

(10) Patent No.: US 12,502,570 B2
(45) Date of Patent: Dec. 23, 2025

(54) TRAMPOLINE

(71) Applicant: bellicon AG, Lucerne (CH)

(72) Inventor: Günter Kopf, Kippenheim (DE)

(73) Assignee: bellicon AG (CH)

( * ) Notice: Subject to any disclaimer, the term of this patent is extended or adjusted under 35 U.S.C. 154(b) by 126 days.

(21) Appl. No.: 18/084,236

(22) Filed: Dec. 19, 2022

(65) Prior Publication Data

US 2023/0226396 A1 Jul. 20, 2023

(30) Foreign Application Priority Data

Jan. 19, 2022 (DE) ..... 10 2022 101 210.7

(51) Int. Cl.
*A63B 5/11* (2006.01)

(52) U.S. Cl.
CPC ..... *A63B 5/11* (2013.01)

(58) Field of Classification Search
CPC ... A63B 5/11; A63B 21/0555; A63B 21/0552; F16G 11/12
See application file for complete search history.

(56) References Cited

U.S. PATENT DOCUMENTS

| | | | | |
|---|---|---|---|---|
| 10,307,628 | B2 * | 6/2019 | Tseng | A63B 5/11 |
| 10,898,748 | B2 * | 1/2021 | Bisang | F16B 45/012 |
| 10,989,275 | B2 * | 4/2021 | Mehr | A63B 5/11 |
| D951,381 | S * | 5/2022 | Wang | D21/797 |
| 2010/0009812 | A1 * | 1/2010 | Pieper Genannt Schmauck | A63B 5/11 482/148 |
| 2013/0316876 | A1 * | 11/2013 | Publicover | A63B 5/11 482/27 |
| 2018/0353789 | A1 | 12/2018 | Tseng et al. | |
| 2019/0143164 | A1 * | 5/2019 | Bisang | A63B 5/11 482/27 |
| 2019/0154115 | A1 * | 5/2019 | Mehr | A63B 5/11 |

FOREIGN PATENT DOCUMENTS

| | | | |
|---|---|---|---|
| CN | 205598498 | U | 9/2016 |
| DE | 10226707 | A1 | 1/2004 |
| DE | 102006028363 | B3 | 8/2007 |
| EP | 2035096 | A1 | 3/2009 |
| EP | 2477703 | B1 | 8/2018 |
| GB | 2590894 | A | 7/2021 |
| KR | 101879132 | B1 | 7/2018 |

OTHER PUBLICATIONS

Office Action for European Patent Application No. 22205551.9, dated Feb. 11, 2025, 3 pages.

* cited by examiner

*Primary Examiner* — Andrew M Kobylarz
(74) *Attorney, Agent, or Firm* — Lippes Mathias LLP

(57) ABSTRACT

The disclosure relates to a trampoline that has a circumferential frame and a bounce mat, which has numerous hooks. The hooks each have at least one receiver that is bordered on one side by a side wall. A cord ring with a joint is placed in each receiver in order to attach the bounce mat to the circumferential frame. The side wall has a first recess in which the joint engages. The joint is retained in the hook by the recess such that the cord ring does not slip while the trampoline is being used.

17 Claims, 9 Drawing Sheets

TRAMPOLINE

BACKGROUND OF THE DISCLOSURE

The invention relates to a trampoline that has the features of the preamble to claim 1.

This type of trampoline has a circumferential frame and a bounce mat with numerous hooks with which the bounce mat is suspended on the frame by means of numerous rings formed by elastic cords.

The hooks each have a receiver that is bordered on one side by a side wall. The side wall forms a part of the receiver. One cord ring is placed in each receiver in order to secure the bounce mat to the circumferential frame. The cord ring is braced against the base of the receiver, from which the first side wall extends upward. This type of trampoline is well known in the field of trampolines.

A single hook with just one receiver is disclosed in DE 102 26 707 A1. A double hook, with two receivers is disclosed in EP 2 035 096 B1. The invention relates to single hooks, double hooks, and other types of hooks.

The cord rings are formed with segments of elastic cord joined at the ends to form a loop. This produces a joint. The cord ring may be thicker at the joint. By way of example, the two ends of the cord section can be joined using two clamps. This joint is not particularly attractive from a visual perspective. It is also the weakest point in the loop.

SUMMARY OF THE DISCLOSURE

The object of the invention is to increase the service life of a trampoline that has cord rings.

This object is achieved with a typical trampoline, characterized according to the invention in that the receiver contains a first recess in which the joint engages.

The invention has numerous advantages. First, the cord ring is centered by the recess. As a result, it does not slip while the trampoline is in use. This reduces the wear.

Furthermore, the invention makes use of the fact that stretch factor at the joint is different that over the course of the rest of the cord ring. When the cord ring is looped over the frame and received in the respective hook, there are four segments of the cord between the frame and the hook, each of which stretches when in use. The joints are normally located in one of these segments in the prior art. This means that this segment is subjected to greater stretching loads than the other segments, due to the reduced elasticity. The greater stretching load results in this segment wearing out more quickly. With the recess according to the invention, the joint is centered and secured in place on the hook. As a result, all of the segments of the cord are stretched in a uniform manner, thus preventing premature wear to the cord ring in one of the segments. This also extends the stretching distance, which has a positive effect on the vibrational behavior.

The invention also improves the appearance of the trampoline, because the joint is no longer visible in the segment of the cord ring between the hook and the frame, where it would be subjected to excessive stretching. In the prior art, it is also the case that the joint can rub against the frame, thus damaging it (through scratching), which is no longer a problem with the invention.

When referring to joints in the framework of the invention, these joints comprise a connection of two ends of a cord, thus forming a ring. By way of example, the two ends can be joined by at least one clamp, as has proven to be advantageous. The clamp can be made of metal, preferably in the form of a wire that is bent. The joint ideally has two such clamps, which are spaced apart from one another. These clamps form the outer edges of the joint.

The at least one joint engages in the receiver according to the invention. The joint is consequently retained in the recess. The joint does not have to engage entirely in the recess. It is sufficient when at least part of the joint engages in the receiver. This status is comprised in the term "engaged."

The recess can have a variety of forms. The important thing is that is performs a centering function for the joint.

One advantageous embodiment is characterized in that the first recess forms a section with a thinner wall than the rest of the side wall. This results in the joint being advantageously retained in the receiver.

In one embodiment of the invention, the side wall is continuous, and the section forms an indentation. The side wall is thinner in the region of the indentation than in the rest of the side wall. The joint engages in the indentation.

In an alternative embodiment, the first recess forms a first open cutout in the side wall. The side wall is therefore interrupted where this open cutout is formed. The joint engages in this first open cutout. This results in a particularly effective retention of the joint. Furthermore, the hooks can be particularly flat, because the joint, which is thicker than the rest of the cord ring, can engage in the first open cutout, or even protrude through it in part.

To obtain an effective centering, it is advantageous when the first recess is larger than the joint in the direction along which the cord ring extends. As a result, the joint is advantageously entirely accommodated in the first recess along the extension of the cord ring.

It is fundamentally possible for the first recess in the first side wall to form a window. In this case, the height of the side wall (toward its exposed end) is greater than the height of the joint. One advantageous embodiment of the invention is characterized in that the side wall has an exposed end, and the open cutout is formed such that it opens toward the exposed end. The side wall consequently forms two sections, which form the borders of the open cutout. The side wall is therefore lower where the open cutout is formed. The advantage with this in comparison with a window is that the height of the side wall (toward the exposed end) can be lower, thus reducing material costs and also facilitating insertion of the joint into the first recess.

Each time the cord ring is subject to a load when the trampoline is in use, the individual segments of the cord are stretched between the hooks and the frame accordingly. Tests have shown that the positions of the joints can shift over time due to the different elasticity thereof in comparison with the rest of the cord ring. It is therefore regarded as particularly advantageous when the recess is in the middle of the receiver in the lateral direction. This results in the joint being retained in the center of the receiver in the lateral direction, i.e. along the circumference of the frame. When the bounce mat is subjected to a centered load, equal forces are applied to both sides of the joints, such that the joint is not pulled in one direction or the other.

Instead of placing the first recess in or on the side wall, the first recess can be placed in or on the base of the recess. In this case, the base assumes the entire centering function. Both the base and the side wall are regarded as part of the receiver, such that the receiver assumes the centering function in general.

In a further development of the invention it has been proposed that a second recess is formed in the base, in which the at least one joint engages. The base therefore advantageously interacts with the joint along with the first recess. In this case, it assumes a part of the centering function.

The second recess in the form of a second open cutout is preferably formed in the base. The base therefore has an interruption where the open cutout is formed. The joint is particularly effectively accommodated therein. The joint engages in the second open cutout, and can also partially protrude through it. As a result, the joint is retained particularly effectively in the receiver.

One advantageous embodiment is characterized in that the first open cutout transitions into the second open cutout. The first and second open cutouts thus advantageously form a continuous hole through the side wall and the base. At the same time, the base forms lateral supporting surfaces for the cord ring where the hole is not formed, on which the cord ring is supported.

The lateral supporting surfaces are advantageously formed by two opposing sides of the hook, between which the second recess is formed, and the two sides are then connected to one another by a web formed at a distance to the second recess. This further reinforces the hook.

It has already been explained in the introduction that the cord ring is preferably formed by a piece of cord, the ends of which extend in opposite directions. These two ends are then joined in order to form the cord ring. The ends are held together at the joint by at least one clamp, preferably two clamps, which exert a clamping force on the two ends. The two ends therefore overlap at the joint. It may be the case that one of the ends of the cord, extending beyond the joint, lies against the base, which may result in a certain load being exerted on the joint. Because of this, it is regarded as particularly advantageous when a third recess is formed in the base, in which the excess end of the ring cord engages, i.e. inserted therein in particular. As a result, the joint can lie evenly on the base of the receiver, such that the joint is subjected to less load.

The hook can have a fastening web for connecting it to the bounce mat, which has a hole at the end, through which a tab on the bounce mat is inserted. This kind of connection is known. The receiver is advantageously delimited by the side wall at one side and by the fastening web at the other side. In this case, the fastening web is also part of the receiver. A fourth recess is advantageously formed in the fastening web, in which the joint engages. The fourth recess further improves the retention of the joint in the receiver.

The invention can be applied to single hooks and double hooks. The invention is particularly effective with the latter. With a single hook, when the cord ring is wrapped around the frame, the resulting loop is placed in a single receiver in the single hook. A double hook has two receivers that are advantageously separated by the fastening web. The joint on the cord ring loop is placed in the receiver according to the invention. The other loop (ideally without a joint) is then placed in the other receiver.

BRIEF DESCRIPTION OF THE DRAWINGS

The invention shall be explained in greater detail below on the basis of preferred exemplary embodiments, in reference to the drawings. Therein.

DETAILED DESCRIPTION OF THE DISCLOSURE

Figure 1:
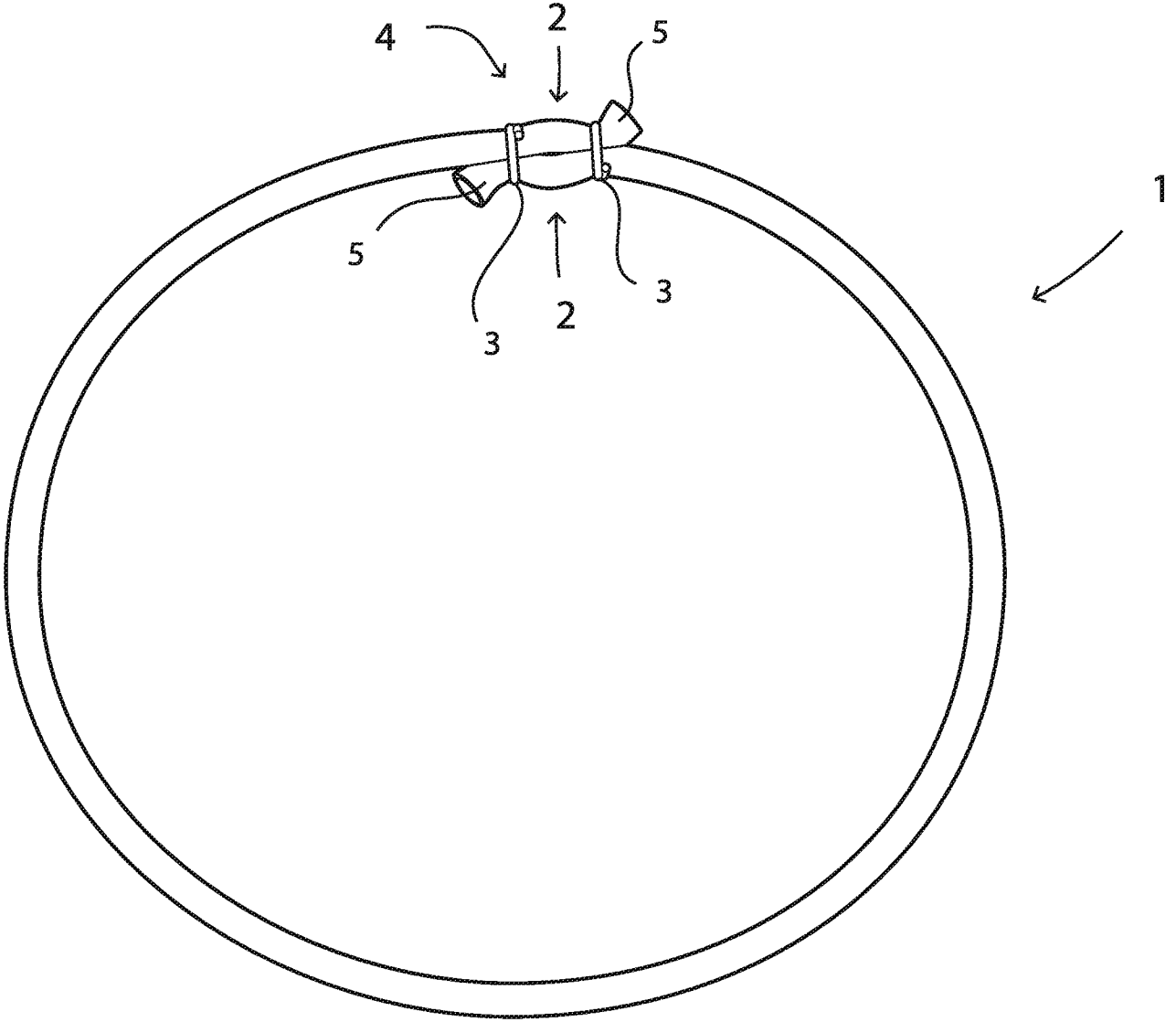
FIG. 1 shows a schematic illustration of a cord ring used in the invention.

FIG. 1 shows a cord ring 1 used with the invention. The cord ring 1 has two ends 2, which are advantageous held together by two clamps 3. The clamps 3 are made of wire wound around the ends 2. A joint 4 is formed by clamping the two ends 2 together. It should be noted here that other joints can be used within the framework of the invention. By way of example, just one clamp 3 may be used. It is also conceivable to form the joint with an adhesive. The ends 2 can also be sewn together. Clamping is nevertheless a simple and tenable means of obtaining a particularly advantageous embodiment.

As can be seen from FIG. 1, the two ends 2 point in opposite directions. The upper end 2 points to the right, and the lower end points to the left in FIG. 1. Exposed, excess ends 5 are formed by the clamps 3, which are outside the joint, and protrude away from the cord ring, depending on the design of the clamp(s) 3, and the clamping force. Further reference shall be made to this below in the description of the drawings.

Figure 2:
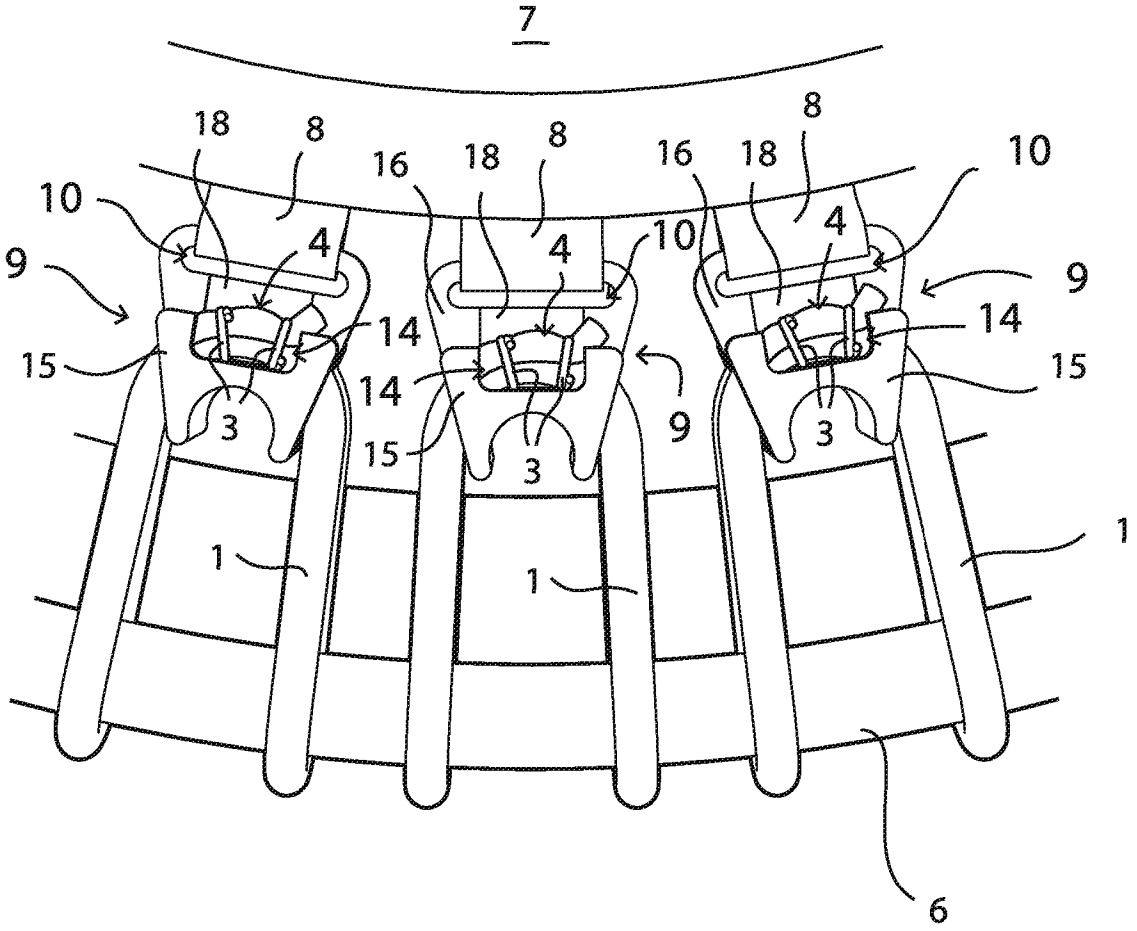
FIG. 2 shows a schematic illustration of a section of a first exemplary embodiment from below.

FIG. 2 shows a section of a first exemplary embodiment of the invention. The trampoline has a circumferential frame 6 and a bounce mat 7 with loops 8 extending from it. The loops 8 are preferably sewn to the bounce mat 7. Hooks 9 are placed in each of the loops 8. These hooks 9 have holes 10 for this, through which the loops pass 8. The bounce mat 7 is suspended inside the frame 6 with the elastic cord rings 1. The cord rings 1 are placed in the hooks 9 and wound around the frame 6. This structure is fundamentally known.

Figure 3:
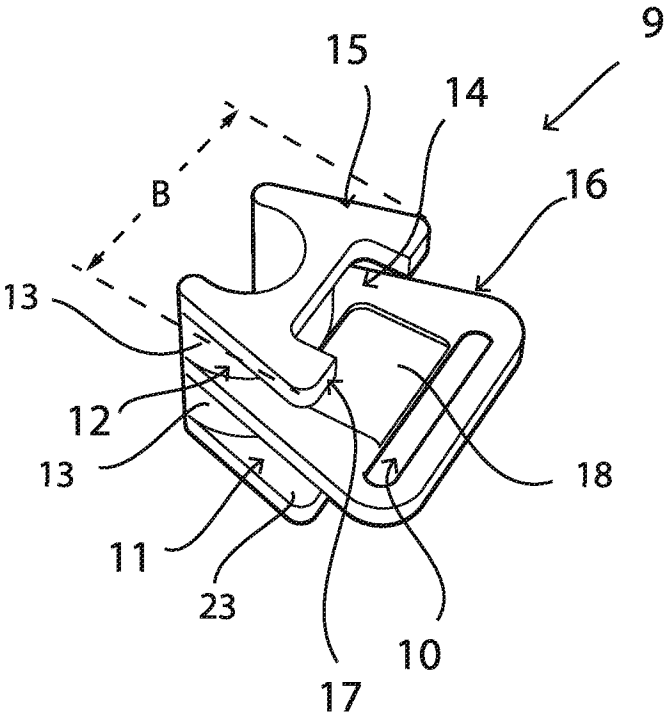
FIG. 3 shows a perspective view of a schematic illustration of a hook from the first exemplary embodiment.

Reference shall be made to both FIGS. 2 and 3 in the following. FIG. 3 shows just the hook 9. In this illustration it is clear that the hook has a lower receiver 11 and an upper receiver 11, into which the respective cord ring 1 is placed (see FIG. 2). The receivers 11, 12 each have a base 13 on which the cord ring 1 is supported when placed therein. The base 13 is preferably at least partially curved, such that the cord ring 1 can slide readily along the base 13 when the trampoline is being used. When referring to the supporting of the cord ring on the base 13 in the framework of the invention, it is regarded as advantageous when the cord ring 1 is supported on the base 13 on at least one side, preferably both sides of the joint 4 in the direction in which the cord ring 1 extends. The base 13 therefore also acts as a support on both sides of the joint 4.

The receiver 12 has a first recess 14, which is preferably formed in a side wall 15 in the present case. The first recess 14 can also be formed in the base 13 or in a fastening web 16 within the framework of the invention, either in and of itself, or in combination with other recesses, as shall be explained in greater detail below. The recess 14 advantageously forms an indentation. The recess 14 is therefore effectively lower than the rest of the side wall 15, the rest of the base 13, and/or the rest of the fastening web 16.

The first recess 14 preferably forms an open cutout in the side wall 15. This means that the side wall 15 is interrupted where the first recess 14 is formed, as can be seen in FIG. 3, by way of example. It should be noted however, that the first recess 14 does not have to pass though the side wall 15 according to the invention. Instead, this can merely be an indentation where the wall is thinner than the rest of the side wall 15, which then faces toward the receiver 12. Nevertheless, an open recess is regarded as advantageous insofar as the joint 4 can then engage with the clamps 3 particularly effectively in the open recess (see FIG. 2). This allows for the hooks to be more compact.

The first recess can form a window in the side wall 15, for example. It is regarded as particularly advantageous when the side wall 15 has an exposed end 17, as shown in the illustration, and the open cutout opens toward the exposed end 17. This allows the joint to engage particularly effectively in the first recess 14. The first recess 14 is preferably in the middle of the recess over the course of its width B. The width B relates to the hole 10 in the fastening web 16 when seen from above. The hole 10 then faces toward the observer.

Another recess is indicated by the reference numeral 18, which preferably forms an indentation in the fastening web 16. This can be the first recess. In the present case, this recess is a fourth recess, which is provided in the side wall 15 in addition to the first recess 14. The first recess 14 and the fourth recess 18 are preferably opposite one another, such that the joint 4 can engage in both the first recess 14 and the fourth recess 18.

Figure 4:
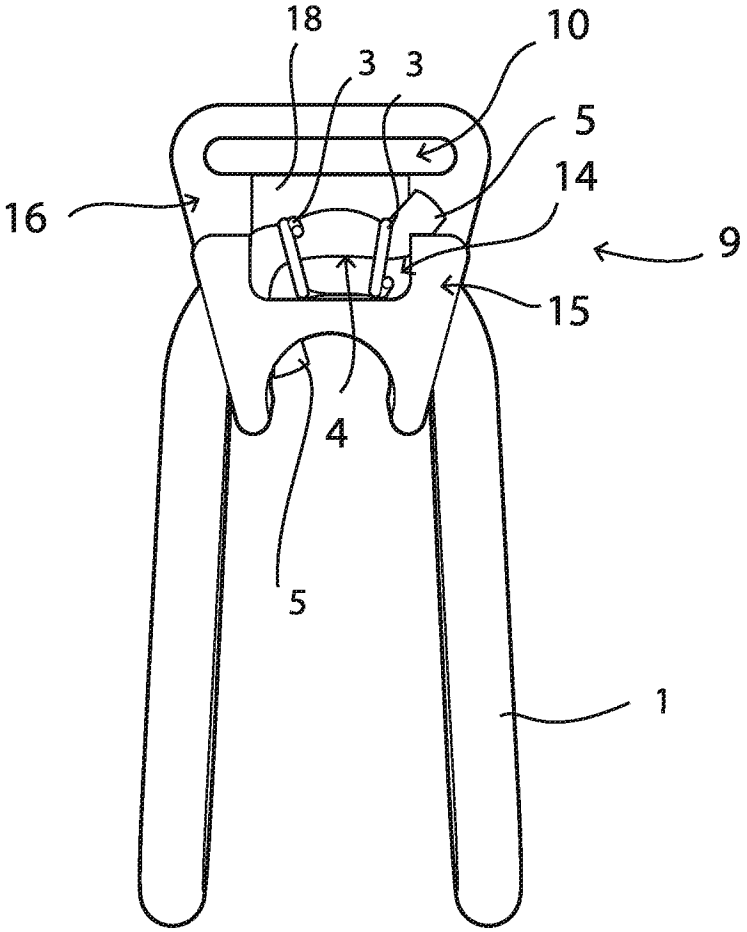
FIG. 4 shows a schematic illustration of a hook from below, with the cord ring placed in it, in a second exemplary embodiment.
Figure 5:
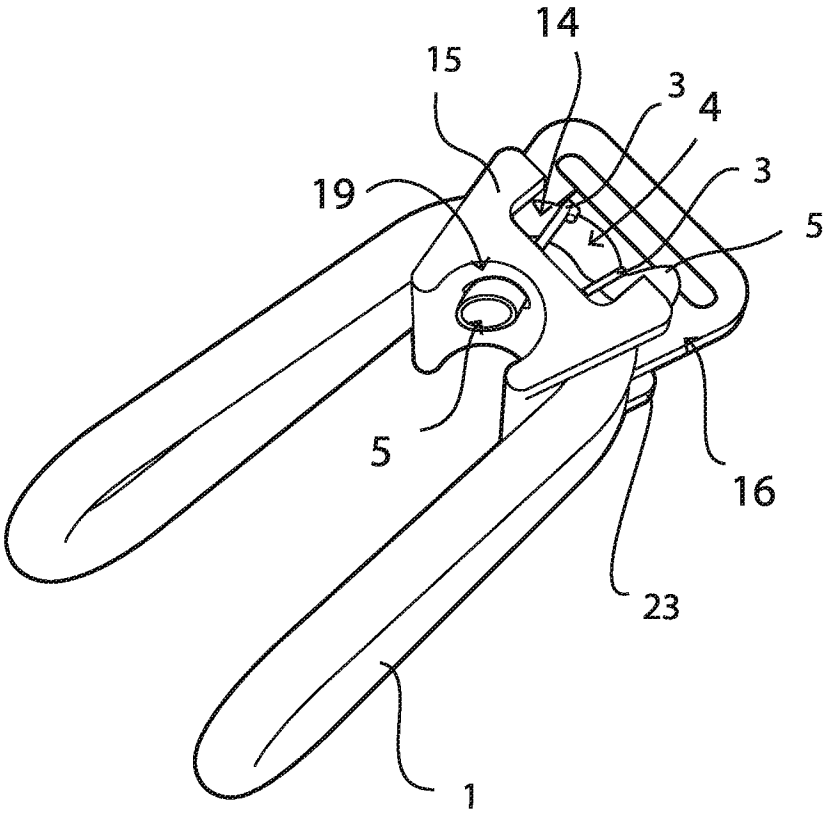
FIG. 5 shows a perspective view of a schematic illustration of the hook in FIG. 4, with the cord ring placed therein.
Figure 6:
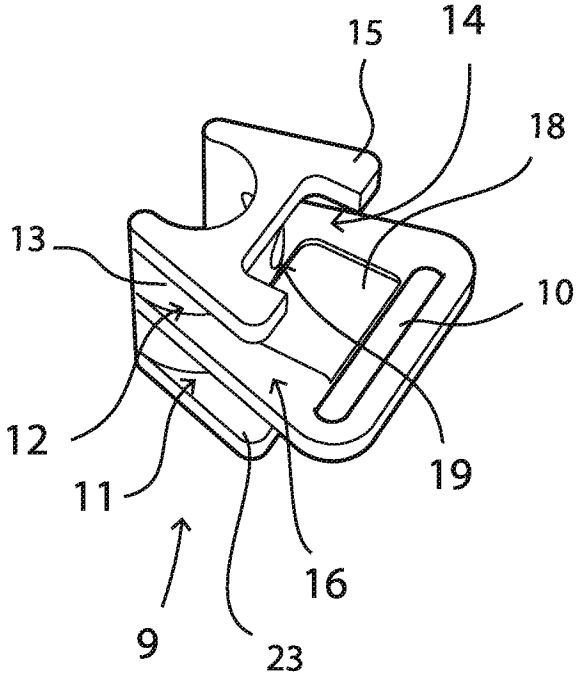
FIG. 6 shows a perspective view of a schematic illustration of the hook in FIG. 4, without the cord ring.

Reference shall be made below to FIGS. 4 to 6, which show a second exemplary embodiment of the invention, in which, for purposes of clarity, only the hook 9 is shown, from below, in FIG. 4 with a cord ring 1 placed in it, a corresponding perspective view of the hook 9 is shown with the cord ring 1 in FIG. 5, and only the hook 9 is shown, by itself, in FIG. 6. The same or functionally similar components are indicated in part with the reference symbols from the first exemplary embodiment for purposes of clarity, even if they are structurally different. Aside from this, the recess 14 in FIGS. 4 to 6 (as well as in the other figures) is shown as being at the top, even if it is preferably located at the bottom and faces downward when the trampoline is assembled for use.

The hook 9 in the second exemplary embodiment, like the first exemplary embodiment, has a first recess 14 and a fourth recess 18. It can also have just a fourth recess 18 or just a first recess 14. The exposed (protruding) ends 5 of the cord ring 1 lying beyond the joint 4 have already been discussed in conjunction with FIG. 1. In a further development of the invention, a third recess 19 is formed in the base 13 (see FIG. 6, into which one of the protruding ends 5 is inserted. The joint 4 is retained particularly effectively in the receiver 12 by this means.

Figure 7:
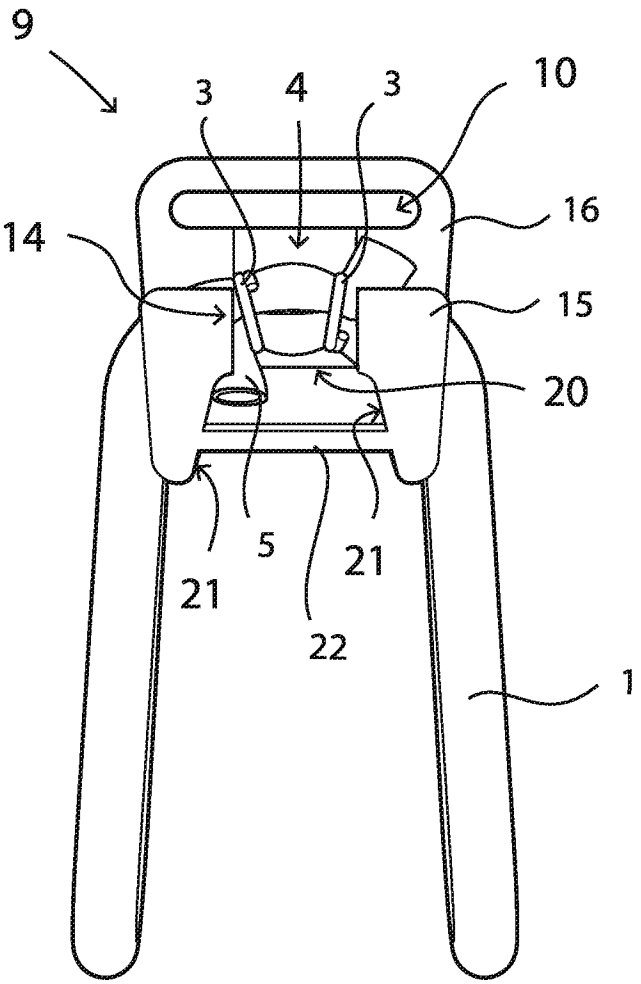
FIG. 7 shows a schematic illustration of a hook from below, with the cord ring placed therein, according to a third exemplary embodiment.
Figure 8:
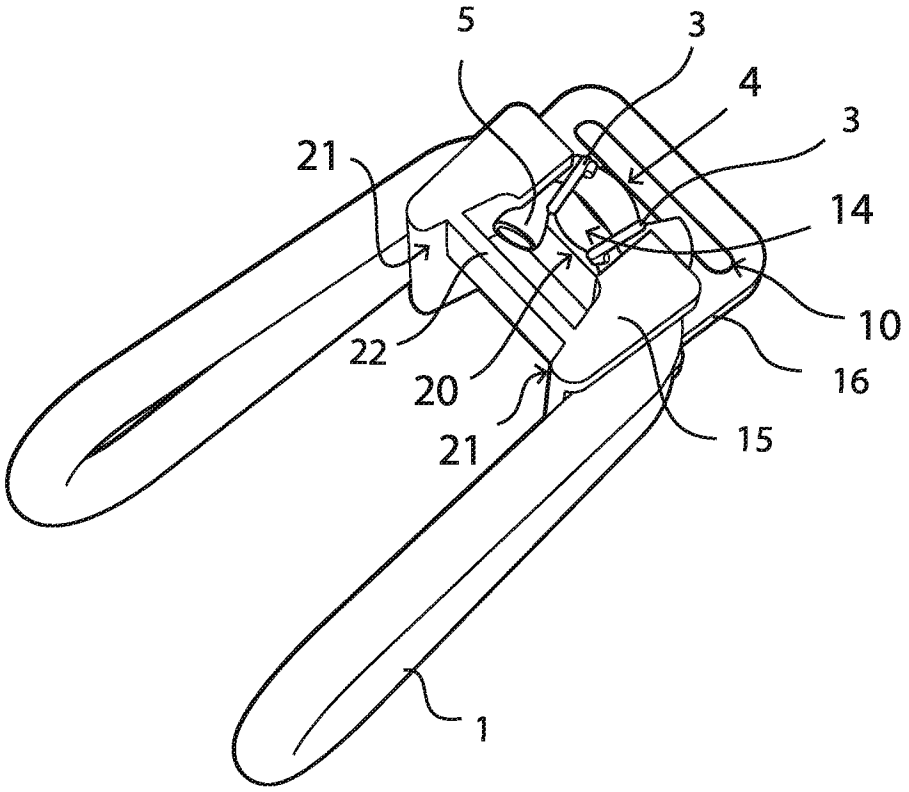
FIG. 8 shows a perspective view of a schematic illustration of the hook from FIG. 7.
Figure 9:
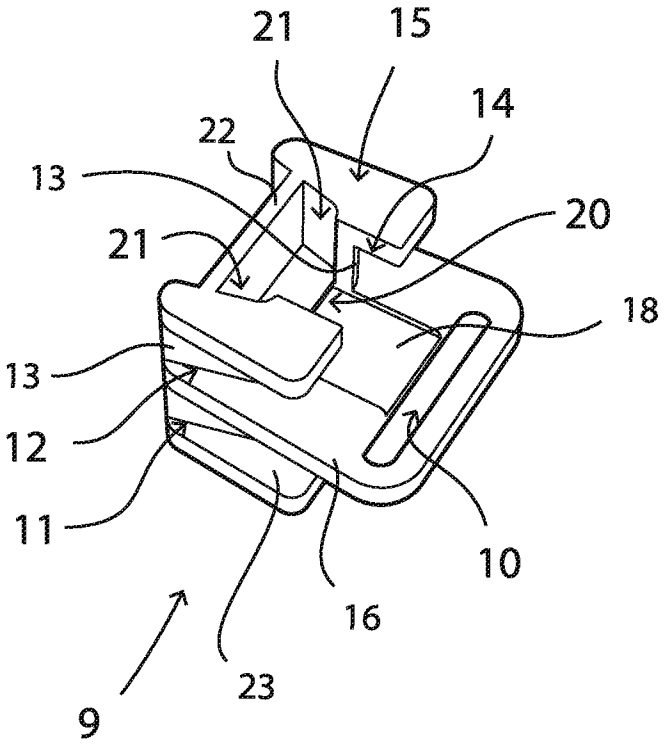
FIG. 9 shows a perspective view of a schematic illustration of the hook from FIG. 7, without the cord ring.

FIGS. 7 to 9 show a third exemplary embodiment. A second recess 20 in which the joint 4 engages is formed in the base 13 here (FIG. 7). The exposed (protruding) end 5 can also engage therein, in a manner regarded as advantageous. The second recess 20 forms a second open cutout in the present case. This results in a hole passing through the base 13. There is preferably a reinforcing web 22 at a spacing to the second recess 20 that extends between the two sides 21 on the back surface of the base 13 that makes the hook 9 more robust.

The exemplary embodiments described herein are in the form of double hooks. They have a first side wall 15 and preferably a second side wall 23 as well. Other structures are conceivable in which there is only one side wall 15 and/or one receiver 12.

LIST OF REFERENCE SYMBOLS

1 cord ring
2 end
3 clamp
4 joint
5 protruding end
6 frame
7 bounce mat
8 loop
9 hook
10 hole
11 receiver
12 receiver
13 base
14 first recess
15 side wall
16 fastening web
17 free end
18 fourth recess
19 third recess
20 second recess
21 side (of the base)
22 reinforcing web
23 second side wall
B width

The invention claimed is:

1. A trampoline comprising:
a circumferential frame, and
a bounce mat having hooks,
wherein the hooks each have at least one receiver bordered at one side by a side wall of the at least one receiver,
wherein a cord ring comprising a joint is placed in each of the at least one receivers in order to attach the bounce mat to the circumferential frame, and
wherein the cord ring is supported on a base of the at least one receiver from which the side wall extends,
wherein
the at least one receiver has a first recess in which the joint engages, and wherein the first recess forms a first open cutout in the side wall.

2. The trampoline according to claim 1, wherein a second recess is formed in each of the bases of each of the at least one receivers of the hooks in which the at least one joint engages.

3. The trampoline according to claim 2, wherein each of the second recesses forms a second open cutout in the respective base.

4. The trampoline according to claim 3, wherein the first open cutout transitions into the second open cutout.

5. The trampoline according to claim 2, wherein each of the bases forms two opposing sides, between which the second recess is formed, and in that the two opposing sides are connected to one another at a spacing to the second recess by a reinforcing web.

6. The trampoline according to claim 1, wherein each of the side walls has a free end and the first open cutout opens toward the free end.

7. The trampoline according to claim 1, wherein each of the first recesses are located in a middle of the receiver over its width.

8. The trampoline according to claim 1, wherein a third recess is formed in each of the bases, into which a protruding end of the respective cord ring is inserted.

9. The trampoline according to claim 1, wherein the at least one receiver is bordered on an other side by a fastening web in which a fourth recess is formed, in which the respective joint engages.

10. A trampoline comprising:

a circumferential frame, and a bounce mat having hooks, wherein the hooks each have at least one receiver bordered at one side by a side wall of said at least one receiver, wherein a cord ring comprising a joint is placed in the at least one receiver in order to attach the bounce mat to the circumferential frame, wherein the joint is formed by at least one clamp, which connects ends of a cord segment wherein distal ends of said cord segment are facing and extending in opposite directions away from each other to form the cord ring; and wherein the cord ring is supported on a base of the at least one receiver from which the side wall extends, wherein the at least one receiver has a first recess in which the joint engages.

11. The trampoline according to claim 10, wherein each of the first recesses forms a section that is thinner than the rest of the side wall.

12. A trampoline comprising:

a circumferential frame, and a bounce mat having hooks, wherein each of the hooks comprises at least one receiver bordered at one side by a side wall of the at least one receiver, wherein said at least one receiver comprises a recess, wherein a cord ring comprising a joint is placed in said recess of said at least one receiver in order to attach the bounce mat to the circumferential frame, and wherein the cord ring is supported on a base of the at least one receiver from which the side wall extends, wherein said recess of said at least one receiver forms a section that is thinner than the rest of the side wall.

13. The trampoline according to claim 12, wherein each of the side walls has a free end and an open cutout opens toward the free end.

14. The trampoline according to claim 12, wherein each of the recesses is located in a middle of the at least one receiver over its width.

15. The trampoline of claim 12, wherein said at least one receiver comprises a first receiver and a second receiver.

16. A trampoline comprising:

a circumferential frame, and a bounce mat having hooks, wherein the hooks each has a recess, wherein said recess has a width to accommodate a joint of a cord ring, wherein the joint is formed by at least one clamp, which connects ends of a cord segment wherein distal ends of said cord segment are facing and extending in opposite directions away from each other to form the cord ring, wherein said cord ring is placed in each recess in order to attach the bounce mat to the circumferential frame, and wherein the cord ring is supported on a base of the hook.

17. A trampoline comprising:

a circumferential frame, and a bounce mat having hooks, wherein each of the hooks comprises a first receiver and a second receiver and each is bordered at one side by a side wall of at least one of the first receiver and the second receiver, wherein said first receiver comprises a recess, wherein a cord ring comprising a joint is placed in said recess of said first receiver in order to attach the bounce mat to the circumferential frame, wherein the joint connects ends of a cord segment wherein distal ends of said cord segment are facing and extending in opposite directions away from each other to form the cord ring, and wherein the cord ring is supported on a base of the first receiver from which the side wall extends.

* * * * *